US006012674A

United States Patent [19]

Leeuwenburgh

[11] Patent Number: 6,012,674

[45] Date of Patent: Jan. 11, 2000

[54] SHEET DISPENSER

[75] Inventor: Peter Leeuwenburgh, Herwijnen, Netherlands

[73] Assignee: TMtape b.v., Gorinchem, Netherlands

[21] Appl. No.: 09/079,257

[22] Filed: May 14, 1998

[30] Foreign Application Priority Data

May 24, 1997 [DE] Germany ..... 29709181 U

[51] Int. Cl.[7] ..... B65D 85/02; B26D 7/00

[52] U.S. Cl. ..... 242/588.6; 83/649

[58] Field of Search ..... 242/596.3, 596.8, 242/588.6; 83/649

[56] References Cited

U.S. PATENT DOCUMENTS

| | | | |
|---|---|---|---|
| 579,177 | 3/1897 | Peraut | 242/588.6 |
| 2,797,054 | 6/1957 | Ruch | 242/596.3 X |
| 2,904,274 | 9/1959 | HIcks | 242/596.3 |
| 4,595,154 | 6/1986 | Swope | 242/596.3 |
| 4,659,028 | 4/1987 | Wren | 242/596.8 |
| 5,228,632 | 7/1993 | Addison et al. | 242/596.8 X |

FOREIGN PATENT DOCUMENTS

8531653 U 9/1985 Germany .

*Primary Examiner*—John Q. Nguyen
*Attorney, Agent, or Firm*—Diller, Ramik & Wight, PC

[57] ABSTRACT

A sheet dispenser with a handheld support (10) and a sheet roll for painting and decorating work consists of a frame (10) surrounding the longitudinal circumference of the roll and comprising two rigid frontal walls (14, 15) with a supporting element (20, 30) each being arranged on the frontal walls (14, 15). The supporting elements (20, 30) are arranged axially opposite each other with the core of the sheet roll being clampable axially between them. At least one supporting element (30) is attached resiliently on the frame (10) in an axial direction by means of a spring element (22). Because of the resilient supporting element, a simple insertion and removal of a sheet roll is possible.

10 Claims, 3 Drawing Sheets

SHEET DISPENSER

BACKGROUND OF THE INVENTION

The invention relates to a sheet dispenser with a hand-held support and a sheet roll for painting and decorating work.

Sheet rolls for painting and decorating work usually consist of paper or plastic rolls folded into several layers and rolled into a sheet roll. Supports are used for a better handling of the sheet rolls into which the sheet roll is rotatably inserted. When the inserted sheet roll is rolled off, the support is held in the one hand, while with the other hand the sheet is rolled off the sheet roll in the desired length and eventually separated.

German Utility Model DE 85 31 653.9 describes a shell-shaped sheet dispenser support, the housing of which, forming a frame, consists of isosceles, octagonally shaped frontal walls between which five sides of the octagon form a circumferential wall of the support housing. In each frontal wall, a hole is provided centrally into which peg-shaped pins respectively projecting from the outside of the housing into the housing can be inserted as supporting elements. To attach a sheet roll, the sheet roll is inserted into the housing, and the peg-shaped plugs are inserted through the holes in the frontal walls into the roll core. Attaching the sheet roll requires skill and is time-consuming.

SUMMARY OF THE INVENTION

It is an object of the invention to simplify the handling of the sheet dispenser.

According to the invention, this object is solved by the features of claim 1.

In the case of the sheet dispenser according to the invention, at least one supporting element of the support is attached for resiliently supporting the roll core with a spring element in an axial direction on the frame or on the frontal wall. The second supporting element of the support on the opposite frontal wall can also be connected to the frontal wall in a resiliently attached or a fixed manner.

The sheet roll is inserted into the support by inserting the roll core into the supporting element, which may be connected fixedly to the frontal wall, and inserting the other end of the roll core into the supporting element attached resiliently to the other frontal wall. In this context, the resilient supporting element is pushed out of the resting position by the roll itself or moved out of the resting position manually. The roll is then pivoted into the support housing until the roll core is aligned with the resilient supporting element, whereupon the resilient supporting element returns into its resting position and engages with the roll core in the resting position. To remove the empty roll, the resilient supporting element is just drawn out of the resting position so that the empty roll can fall out or be taken out of the housing.

The supporting elements are connected to the frame of the support so as not to get lost. The spring force of the resilient supporting element is so high that the core of the sheet roll cannot come off the supporting elements when a sheet is rolled off the sheet roll, even if the sheet is pulled strongly. Handling the support when inserting a sheet roll or removing the empty roll is thus simplified and less time-consuming.

Preferably, the spring element is a spring tongue on the level of the frontal wall, the supporting element being arranged on the freely resilient end thereof. In this manner, the spring element is put into practice in a simple form.

In a preferred embodiment, the supporting elements are formed as pegs projecting into the interior of the frame. The pegs engage with axial openings of the core of the sheet roll, whereby the sheet roll is supported securely in the sheet dispenser, the sheet roll to be inserted into and removed from the support in a simple way. The pegs can also be formed such as to enclose an axially projecting section of the roll core from the outside. However, the supporting element can also be formed as an opening into which projecting ends of a roll core can be inserted.

Preferably, the frame, the supporting elements and the spring element are formed integrally with one another. This reduces the production costs for the support, with all the parts being connected captively and integrally to one another. Preferably the support is made of plastics, whereby low production costs and a low weight can be achieved.

In a preferred embodiment, the flame is formed as a rectangular frame. The frame can be formed by a semicylindrical lateral wall and the frontal walls. Thus, the frame encloses about half the sheet roll employed. The frame can be held comfortably in one hand without touching and braking the sheet roll. Because of the semi-open design of the frame, however, the sheet roll can be braked by the fingers of the holding hand or can be held fast for tearing off the rolled-off sheet. Furthermore, the semicylindrical design of the frame housing allows to use little material in the production of the support.

In a preferred embodiment, the frontal walls are formed approximately semicircular, with the supporting elements arranged in the cylinder axis at least partially projecting over the edge of the frontal walls. This design of the frontal wall is especially important in the case of the frontal wall with the fixedly, non-resiliently arranged supporting element or the supporting element whereon the roll core is put on first when the sheet roll is inserted. During insertion, the sheet roll is at first put on the fixed supporting element in a tilted manner, i.e. not axially to the cylinder axis of the housing. In this context, one half of the sheet roll end projects axially beyond a lateral wall. As no lateral wall is provided in the area of the projecting sheet roll end, the core of the sheet roll can be put onto the supporting element approximately completely without the frontal side of the sheet roll end abutting on the lateral wall and preventing the core from being put on the wall in approximately its entirety. The lateral wall extending up to a maximum of half the cylinder thus allows for a simple and good assembly of the roll core to the fixed supporting element.

In a preferred embodiment, the spring tongue is a strip-like flexible part extending radially to the circumference of the cylinder. Thus the spring tongue has a great length, is correspondingly flexible and thereby allows for a greater excursion of the resilient supporting element moved away from the resting position thereof.

Preferably, the spring element comprises a projection for actuating the spring element. By means of the projection, the spring element can easily and reliably be moved out of the resting position by means of a finger to allow for the introduction or the removal of the sheet roll.

In the case of sheet rolls with adhesive tape, the end of the sheet roll comprising the adhesive tape is put on the non-resilient supporting element. A separation of a rolled-off sheet section on a cutting edge occurs from the side of the adhesive tape. In this context, the support is held in the hand on this end, which can be made easier by gripping structures.

In the case of further preferred embodiments, the non-resiliently attached peg is beveled on the frontal side thereof, or the non-resiliently attached peg consists of a peg body of a short axial length being supported on an axial peg arm of a diameter which is smaller than that of the peg body. Thus it is simplified to put on the roll core on the stationary, non-resiliently attached peg in a tilted manner while keeping it from jamming.

Preferably, the suspension element is formed as an axial arc limiting the axial excursion of the spring element towards the outside thereof. Thereby, the spring element is reliably kept from being bent excessively and broken off.

BRIEF DESCRIPTION OF THE DRAWINGS

Embodiments of the invention will now be described in greater detail with reference to the drawings.

DESCRIPTION OF THE PREFERRED EMBODIMENTS

Figure 1:
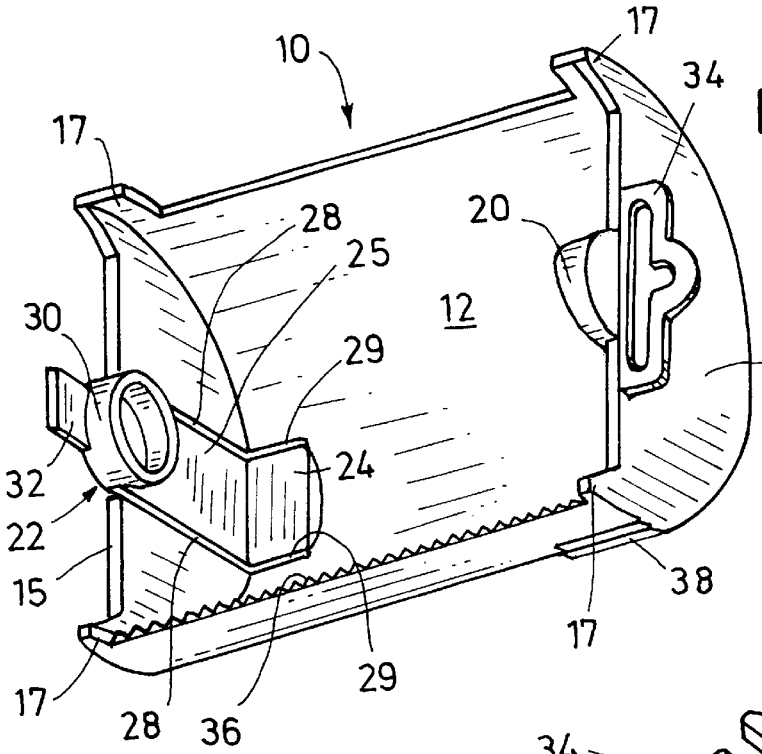
FIG. 1 shows the inside of a first sheet roll support in a perspective representation.
Figure 2:
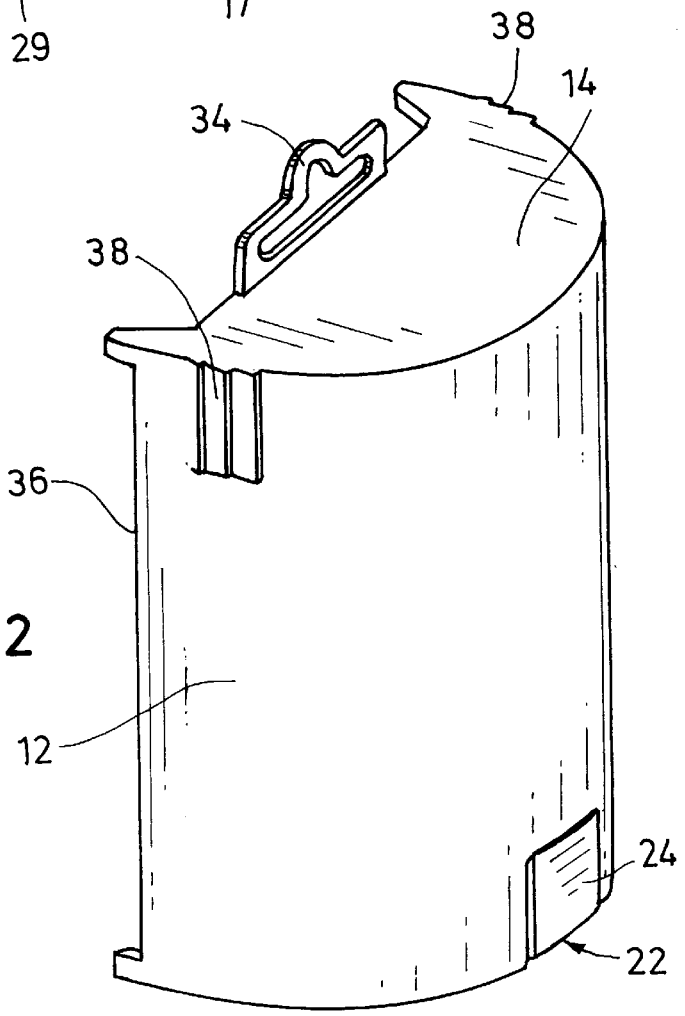
FIG. 2 shows the outside of the sheet roll support of FIG. 1.

FIG. 1 shows a sheet roll support used for supporting a sheet roll and for rolling and tearing off a sheet section. The sheet is used for covering and pasting in painting and decorating work.

The sheet roll support consists of a housing 10 forming a rectangular frame substantially formed of a semicylindrical lateral wall 12 and approximately semicircular frontal walls 14, 15 limiting the lateral wall 12 on both axial ends. The housing 10 thus has the shape of a closed hollow cylinder halved on an axial level. The four comer areas 17 of the housing 10 project from the edge of the housing 12 by a few millimeters in a circumferential direction. On the one frontal wall 14, an annular peg 20 projecting into the interior of the housing is arranged projecting beyond the lateral edge of the frontal wall 14 at half the circumference thereof. The frontal surface of the peg 20 is beveled radially towards the interior of the housing.

In the area of the other frontal wall 15, an L-shaped spring tongue 22 is provided as a spring element. The short arm 24 of the spring tongue 22 forms an axial part of the lateral wall 12, while the long arm 25 forms a part of the spring tongue 22 extending radially from the short arm 24, i.e. from the lateral wall edge, towards the center of the cylinder housing 10. The edge area between the short arm 24 and the long arm 25 of the spring tongue 22 is formed to be reinforced in the material thereof. On the longitudinal sides of the arms 24, 25, the spring tongue 22 is separated from the frontal wall 15 or the side wall 12 by radial or axial slots 28, 29. Both arms 24, 25 of the spring tongue 22 are flat and plane, i.e. formed flexibly over the entire length of the spring tongue 22. The end of the short arm 24 turned away from the long arm 25 is connected fixedly and integrally to the lateral wall 12.

On the free end of the long arm 25 of the spring tongue 22, a second peg 30 is arranged projecting into the housing 10 axially directly opposite. By arranging the peg 30 on the free end of the spring tongue 22, the peg 30 is arranged resiliently in an axial direction so that it can be moved from a resting position in which the peg 30 axially projects into the housing 10 into a releasing position in which the peg 30 no longer projects into the housing 10 (see FIGS. 3 to 5).

A half of the peg 30 of the spring tongue 22 also projects outwardly, radially on the circumference, beyond the edge of the frontal wall 15. On the end of the peg of the long arm 25 of the spring tongue 22, a web-like projection 32 is provided for manually actuating the spring tongue 22, which projection projects radially from the peg 30. The peg 30 is also annular in shape. The two pegs 20, 30 are adapted in the exterior circumference to the interior circumference of the core 42 of a sheet roll 40 so that the pegs 20, 30 are insertable into the core 42.

On the one frontal wall 14, a suspension element 34 is arranged axially projecting outwardly from the frontal wall 14, whereon the housing 10 can be suspended in sales stands on corresponding suspension devices.

On a longitudinal edge of the lateral wall 12, a knife 36 is embedded in the lateral wall 12 across the entire length of the lateral wall 12, which knife serves to separate a sheet section from the sheet roll 40. Furthermore, on the lateral wall 12 in the edge area towards the frontal wall 14 comprising the stationary pegs 20, stair-like gripping structures 38 are provided on both sides approximately on the edges.

Figure 3:
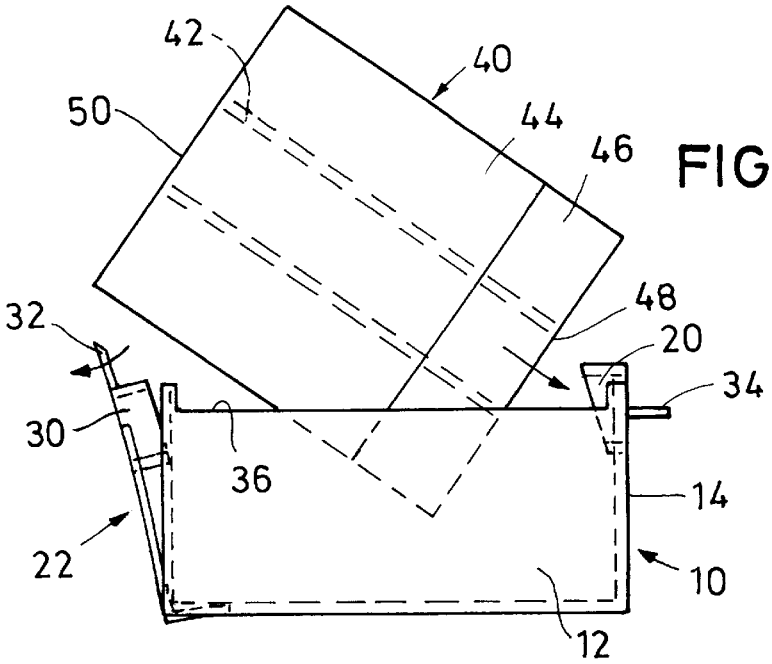
FIG. 3 shows a lateral view of the sheet roll support of FIG. 1 with a sheet roll to be inserted.
Figure 4:
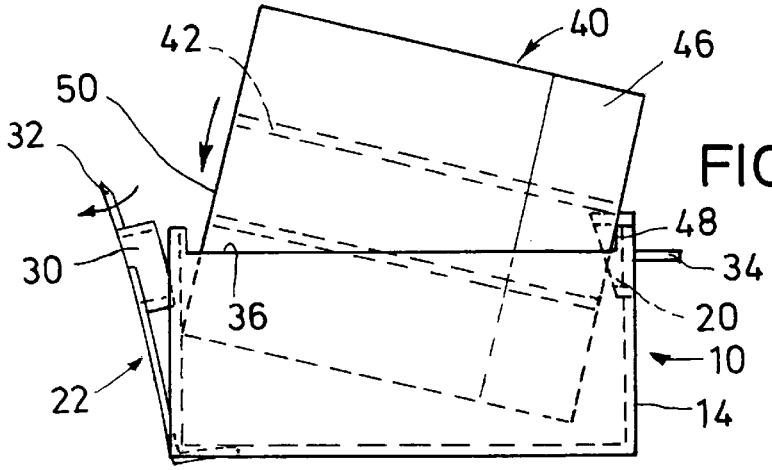
FIG. 4 shows the sheet roll support of FIG. 1 with the sheet roll being inserted, with one end thereof, in the stationary supporting element.
Figure 5:
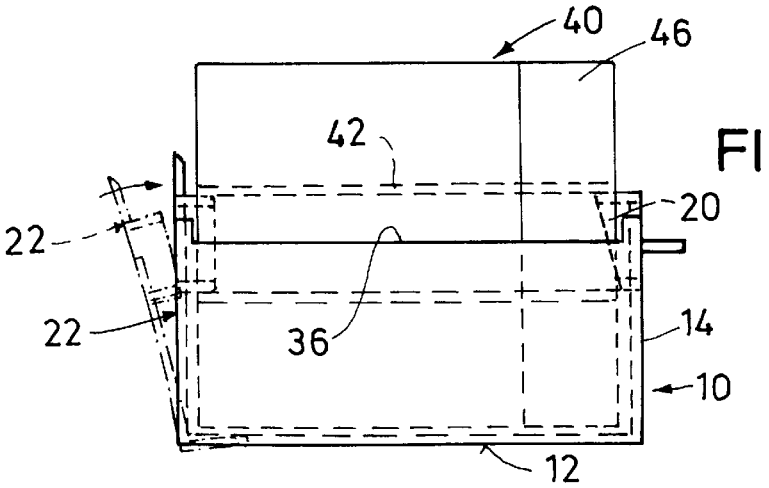
FIG. 5 shows the sheet roll support of FIG. 1 with a completely inserted sheet roll.

In FIGS. 3 to 5, the process of inserting a sheet roll 40 into the housing 10 is represented. A cover sheet 44 folded into multiple layers is rolled on a tubular core 42 of the sheet roll 40, which cover sheet comprises an adhesive strip, on the one end thereof, i.e. on the axial end of the sheet roll 40.

At first the sheet roll 40 is introduced obliquely, with the leading end being the end with the adhesive tape, into the housing 10 towards the frontal wall 14 comprising the stationary peg 20 (FIG. 3).

A first insertion opening 48 of the roll core 42 is put obliquely on the stationary peg 20. As can be seen in FIG. 4, it is possible to fit the first core opening 48 deeply onto the stationary peg 20 due to the small height of the frontal wall 14. The bevel of the stationary peg 20 prevents the roll core 42 from jamming on the peg 20 when being put on, as the roll core 42 at first only engages the part of the peg 20 projecting beyond the profile of the housing.

Now, at the latest, the projection 32 of the spring tongue 22 is grasped with a finger and the spring tongue is pulled axially outward so that the peg 30 fixed thereto no longer projects into the interior of the housing (FIG. 4). Then the sheet roll 40 is pivoted into the housing so that it comes to rest in the housing 10. Only now does the roll core also engage the part of the stationary peg 20 in the interior part of the housing. Now the projection 32 of the spring tongue 22 is released again so that the spring tongue peg 30 engages the second open end 50 of the roll core 42. Thus, the sheet roll 40 is pivoted on the two ends with the two pegs 20, 30 in a freely rotatable manner.

To remove the empty roll core 42, the projection 32 of the spring tongue 22 is grasped again and pulled axially to the outside whereupon the roll core 42 can fall out of the housing 10.

If a sheet section is to be separated from the sheet roll 40, the housing 10 is most practically held in the right hand with thumb and index finger each holding the housing 10 in the area of the gripping structures 38. A free end of the sheet 44 is drawn off from the sheet roll 40 with the left hand until the desired length of sheet has been rolled off. Then the sheet section rolled off is cut on the knife 36 by the sheet being put over the knife 36 axially from the axial end with the stationary peg 20 towards the other end and being torn off. A sheet roll support which can be held in the left hand comprises the knife and may comprise the gripping structures on the opposite longitudinal edge.

The housing 10 is produced integrally of polyethylene including the pegs 20, 30 and the spring tongue 22, but it can also comprise other materials.

The interior diameter of the housing 10 approximately amounts to 80 mm, and the axial interior length of the housing varies between 102 and 202 mm depending on the axial length of the sheet roll 40. The thickness of the lateral and frontal walls 12, 14, 15 is 3 mm. Between the inserted sheet roll 40 and the interior side of the lateral wall 12 there is only a small gap of 1 to 2 mm.

The non-resiliently attached peg 20 can be beveled on the frontal side thereof. The non-resiliently attached peg can comprise a peg body of a short axial length being supported on an axial peg arm of a smaller diameter than the peg body.

Figure 6:
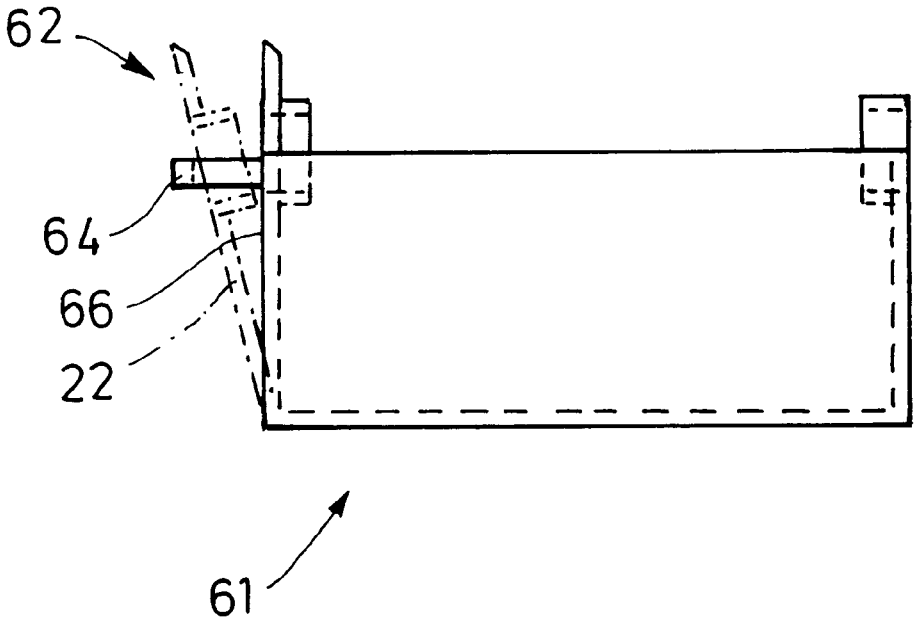
FIG. 6 shows a lateral view of a second sheet roll support with a suspension element limiting the axial excursion of the spring element.

In a second exemplary embodiment of a support 61 represented in FIG. 6, an arc-like suspension element 64 is arranged projecting axially outwards from the frontal wall 66 comprising the spring element 62. In this manner, the axial spring excursion of the spring elements 62 is limited to the outside by the suspension element arc 64 so that the spring element 22 is reliably prevented from being bent excessively and breaking off, which would be undesirable.

I claim:

1. A hand-held sheet dispenser comprising a hand-held support (10) and a sheet roll (40) for painting and decorating work, said hand-held support (10) including a semi-cylindrical wall (12) closed at axially opposite semi-cylindrical edge portions by axially spaced substantially semi-circular end walls (14, 15), said axially spaced end walls (14, 15) including respective axial aligned supporting elements (20, 30) between which a core (42) of the sheet roll (40) is rotatably clamped, at least one of said supporting elements (30) being resilient axially by means of a spring element (22), and said spring element (22) being a strip-like flexible tongue (25) extending radially along one of said end walls (15) from a chordal edge thereof to one of said semi-cylindrical edge portions of said semi-cylindrical wall, wherein the end walls each includes a chordal edge, and the supporting elements lie on an axis of the semi-cylindrical wall and project at least partially radially beyond the chordal edges of the end walls and the spring element includes a projection for actuating the spring element (12).

2. The hand-held sheet dispenser as defined in claim 1 wherein the spring element (22) lies in a common plane of said one end wall (15).

3. The hand-held sheet dispenser as defined in claim 1 wherein said supporting elements are pegs (20, 30) axially projecting toward each other.

4. The hand-held sheet dispenser as defined in claim 1 wherein said semi-cylindrical wall (12), the axially spaced end walls (14, 15), the supporting elements (20, 30) and the spring element (22) are collectively of a one-piece integral construction.

5. The hand-held sheet dispenser as defined in claim 4 including a suspension element (64) defining an axially projecting curved wall axially outboard of and retaining said spring element (62) to thereby limit the axial outward movement of the spring element (62).

6. The hand-held sheet dispenser as defined in claim 4 wherein said semi-cylindrical wall (12) includes opposite substantially parallel longitudinal edges, and means (36) along one of said longitudinal edges for severing sheets from said sheet roll (40).

7. The hand-held sheet dispenser as defined in claim 6 including a suspension element (34; 64) adjacent one of said supporting elements (20, 30) and projecting axially outwardly thereof.

8. The hand-held sheet dispenser as defined in claim 1 including a suspension element (34; 64) adjacent one of said supporting elements (20, 30) and projecting axially outwardly thereof.

9. The hand-held sheet dispenser as defined in claim 8 wherein the suspension element (64) defines an axially projecting curved wall axially outboard of and retaining said spring element (62) to thereby limit the axial outward movement of the spring element (62).

10. The hand-held sheet dispenser as defined in claim 1 wherein said semi-cylindrical wall (12) includes opposite substantially parallel longitudinal edges, and means (36) along one of said longitudinal edges for severing sheets from said sheet roll (40).

* * * * *